US009303661B2

(12) United States Patent
Fagerlund et al.

(10) Patent No.: US 9,303,661 B2
(45) Date of Patent: Apr. 5, 2016

(54) CONTROL ARRANGEMENT

(75) Inventors: Christian Fagerlund, Bredared (SE); Jonathan Tresadern, Swindon (GB)

(73) Assignee: EATON LIMITED, Titchfield, Hampshire (GB)

( * ) Notice: Subject to any disclaimer, the term of this patent is extended or adjusted under 35 U.S.C. 154(b) by 359 days.

(21) Appl. No.: 13/386,281

(22) PCT Filed: Jul. 20, 2010

(86) PCT No.: PCT/EP2010/060503

§ 371 (c)(1), (2), (4) Date: Apr. 5, 2012

(87) PCT Pub. No.: WO2011/009870

PCT Pub. Date: Jan. 27, 2011

(65) Prior Publication Data

US 2012/0181459 A1 Jul. 19, 2012

(30) Foreign Application Priority Data

Jul. 20, 2009 (GB) ..... 0912550.1

(51) Int. Cl.
*F15B 19/00* (2006.01)
*F15B 13/043* (2006.01)

(52) U.S. Cl.
CPC ..... *F15B 13/043* (2013.01); *F15B 19/005* (2013.01); *F15B 2211/3057* (2013.01); *F15B 2211/6336* (2013.01)

(58) Field of Classification Search
CPC ..... F15B 2211/327; F15B 2211/3057; F15B 13/044; F15B 13/0442; F15B 2211/6336
USPC ..... 251/30.01, 129.04; 137/596.16, 625.64; 91/434, 435, 463, 464
See application file for complete search history.

(56) References Cited

U.S. PATENT DOCUMENTS 4,187,681 A 2/1980 Johnson
4,767,162 A 8/1988 Reed, III et al.

(Continued)

FOREIGN PATENT DOCUMENTS

DE 102006049491 A1 4/2008
GB 1148126 4/1969

(Continued)

OTHER PUBLICATIONS

European Patent Office; International Search Report and Written Opinion issued in corresponding International Application No. PCT/EP2010/060503. Date of Mailing: May 11, 2010.

(Continued)

*Primary Examiner* — Matthew W Jellett
(74) *Attorney, Agent, or Firm* — Dykema Gossett PLLC

(57) ABSTRACT

A control arrangement for use in a hydraulic control system including a control valve having at least two movable elements, such as spools or poppets, that is adapted to control a main flow through the control valve. The control arrangement further includes a control unit. In an embodiment the control arrangement is adapted to control the operation of the control valve in accordance with a first control scheme, monitor an operating parameter of the control system, and control the operation of the control valve in accordance with a second control scheme in the event that the value of the operating parameter falls outside of a predetermined range.

20 Claims, 1 Drawing Sheet

(56) References Cited

U.S. PATENT DOCUMENTS

| | | | | |
|---|---|---|---|---|
| 5,138,838 | A * | 8/1992 | Crosser | 60/433 |
| 5,211,196 | A * | 5/1993 | Schwelm | 137/596.2 |
| 5,299,420 | A * | 4/1994 | Devier et al. | 60/403 |
| 5,960,695 | A * | 10/1999 | Aardema et al. | 91/433 |
| 6,047,228 | A | 4/2000 | Stone et al. | |
| 6,257,118 | B1 | 7/2001 | Wilbur et al. | |
| 6,467,264 | B1 * | 10/2002 | Stephenson et al. | 60/460 |
| 6,619,183 | B2 * | 9/2003 | Yoshino | 91/454 |
| 6,775,974 | B2 * | 8/2004 | Tabor | 60/422 |
| 6,779,340 | B2 * | 8/2004 | Pfaff et al. | 60/422 |
| 7,210,396 | B2 * | 5/2007 | Kuehn et al. | 91/454 |
| 7,422,033 | B2 * | 9/2008 | Barber | 137/625.64 |
| 7,451,685 | B2 * | 11/2008 | Tabor | 91/361 |
| 2003/0106420 | A1 * | 6/2003 | Yoshino | 91/454 |
| 2003/0110934 | A1 * | 6/2003 | Linerode | 91/459 |
| 2003/0221730 | A1 | 12/2003 | Porter | |
| 2004/0055453 | A1 * | 3/2004 | Tabor | 91/433 |
| 2007/0033934 | A1 * | 2/2007 | Yamazaki et al. | 60/459 |
| 2007/0044465 | A1 * | 3/2007 | Zhang et al. | 60/459 |
| 2012/0279212 | A1 * | 11/2012 | Fagerlund et al. | 60/462 |

FOREIGN PATENT DOCUMENTS

| | | | |
|---|---|---|---|
| GB | 1255662 | | 12/1971 |
| GB | 2102761 | A | 2/1983 |
| GB | 2171461 | A | 8/1986 |
| JP | 11181840 | A | 7/1999 |
| WO | 2006122339 | A1 | 11/2006 |

OTHER PUBLICATIONS

Intellectual Property Office, UK; Combined Search and Examination Report for priority application No. GB0912550.1. Date of Report: Nov. 19, 2009.

* cited by examiner

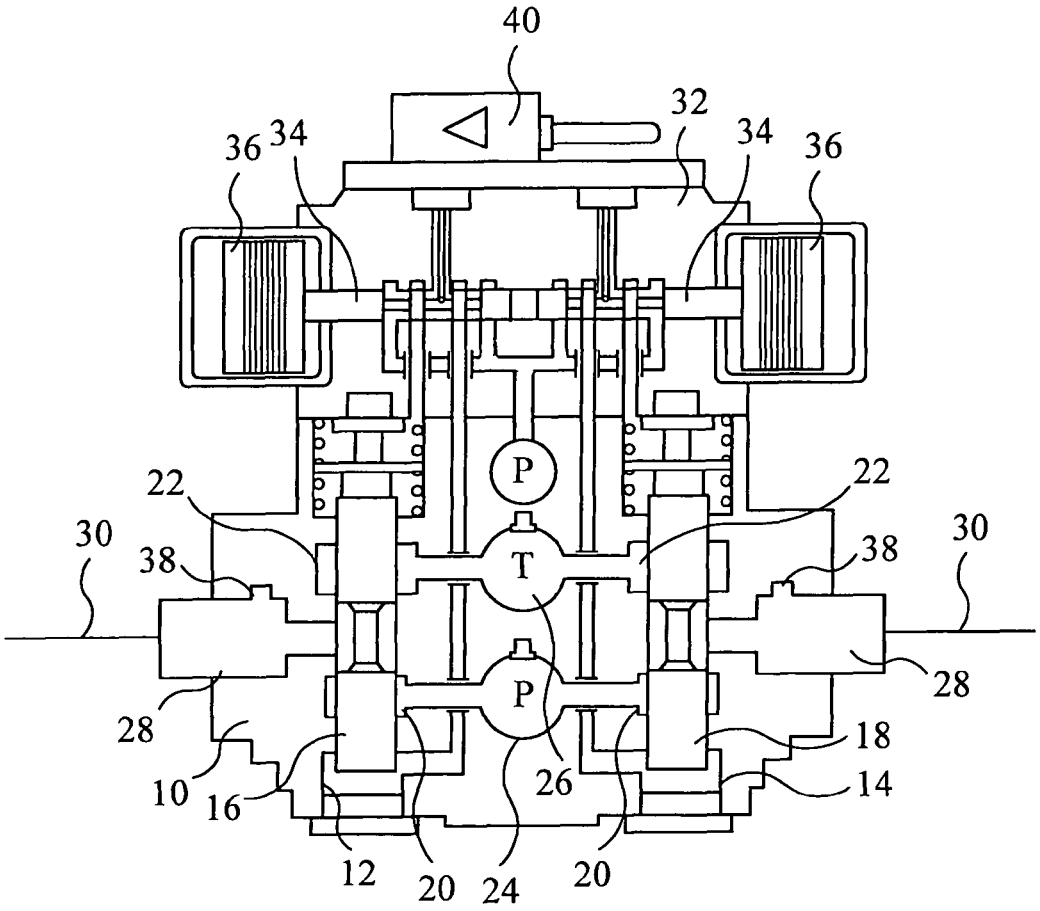
40
32
36
34
34
36
P
22
22
30
38
T
38
30
28
P
28
18
10
16
26
14
12
20
24
20

CONTROL ARRANGEMENT

CROSS-REFERENCE TO RELATED APPLICATIONS

This application is a national stage filing based upon International PCT Application No. PCT/EP2010/060503, with an international filing date of Jul. 20, 2010, which claims the benefit of priority to UK Patent Application No. 0912550.1, filed Jul. 20, 2009, each of which applications are fully incorporated herein by reference as though fully set forth herein.

TECHNICAL FIELD

This invention relates to a control arrangement, and in particular to a method of controlling the operation of a control valve of the type having, preferably, two or more movable or slidable elements (referred to hereafter as a twin spool control valve) to permit improved control over the operation of a device or vehicle, the operation of which is controlled using the control valve.

BACKGROUND

Hydraulic control systems are in widespread use in controlling the operation of excavating equipment, hoists, lifting arms and a number of similar devices. The control systems used therein typically include control valves in the form of a spool slidable within a bore, the position of the spool determining which of a pair of outlet ports is connected to relatively high pressure fluid and which is connected to a low pressure at any given time.

More recently, twin spool control valves have been used. Such arrangements have several advantages over single spool arrangements as the positions occupied by the two spools can be controlled individually. However, the control schemes typically used to drive such control valves are very similar to those that have been used successfully in relation to the single spool arrangements.

It is an object of the invention to provide a control arrangement for such a control valve which permits enhanced performance of a device control using the control valve.

SUMMARY

According to the present invention there is provided a control arrangement for use in a hydraulic control system including a control valve of the type having at least two movable elements, comprising the steps of:

controlling the operation of the control valve in accordance with a first control scheme;

monitoring an operating parameter of the control system; and controlling the operation of the control valve in accordance with a second control scheme in the event that the value of the operating parameter falls outside of a predetermined range.

It will be appreciated that further control schemes may be present, which control scheme is used being dependent upon the value of the operating parameter.

For example, the operating parameter which is monitored may be representative of the position of, or speed of movement of, for example, a hoist, the control system being operable to switch between the first control scheme and the second control scheme when the position of the hoist exceeds a predetermined position. The first control scheme may be arranged to achieve a relatively large change in position for a given movement of a control actuator, for example in the form of a joystick, the second scheme achieving a smaller change in position for the same movement of the control actuator. It will thus be appreciated that, once the hoist has moved beyond a predetermined position, a greater degree of control accuracy is attained.

In addition to permitting enhanced control, such a system is less susceptible to 'hunting' type problems, when the system pressure oscillates about a desired pressure, which, again, permits an improvement in control accuracy.

In another example, improved control over the commencement of motion may be attained in circumstances in which the motion or load is not subject to external actions capable of supplying energy to the hydraulic system, such as the action of gravity or spring loadings. One example of such motion is slewing motion. In such an arrangement the parameter monitored may be related to the speed of slew motion. When the motion is slow, a first control scheme which incorporates a stability function to assist control in such circumstances may be used, a second control scheme not including such functionality being used when the slew motion exceeds a predetermined speed. Although speed is mentioned herein, other parameters could be used.

As with the first example, such an arrangement permits the avoidance or reduction of 'hunting', and in addition may allow operating efficiencies to be made.

BRIEF DESCRIPTION OF THE DRAWINGS

Embodiments of the invention will now be described, by way of example, with reference to the accompanying drawings, wherein:

FIG. 1 is a diagrammatic view of a control system in accordance with an embodiment of the invention.

DETAILED DESCRIPTION

Referring to FIG. 1 there is illustrated, diagrammatically, a twin spool control valve for use in controlling the operation of the control system of a piece of equipment, for example an excavator, crane, hoist, or the like, at least some functions of which are controlled hydraulically. The control valve comprises a main valve block 10 in which valve bores 12, 14 are formed. Each bore 12, 14 houses a respective spool 16, 18 (forming the twin spools of the control valve). Connected to the main valve block 10, in use, are supply and return pressure lines which are each connected to respective ports 20, 22 opening into the bores 12, 14 via supply and return pressure lines 24, 26. Each of the bores 12, 14 further includes or has associated therewith a control port 28, and it will be appreciated that the position of each spool 16, 18 within its associated bore 12, 14 determines whether each of the control ports 28 communicates with the associated supply port 20 or the associated return port 22. In FIG. 1, if the left hand spool 16 occupied a raised position, the spool 16 would close the supply port 20, communication being permitted in a relatively unrestricted manner between the control port 28 and the return port 22. In contrast, if the right hand spool 18 occupied a lowered position, the return port 22 would be closed by the spool 18, communication being permitted between the supply port 20 and the control port 28.

If the main valve block 10 were mounted upon, say, a hoist, the pressures in the control lines 30 connected to the control ports 28 may be used in controlling the position of the lifting arm of the hoist. For example, the position of the spools 16, 18 mentioned above may result in raising of the arm due to fluid at supply pressure being supplied via the bore 14 to one end of a piston used in controlling the position of the arm, fluid from the opposite end of the piston being able to flow to return via the other bore 12. Downward movement of the spool 16 and upward movement of the spool 18 will switch the piston connections, resulting in the arm being lowered.

The positions occupied by the spools 16, 18 are controlled by a pilot valve block 32 which controls the volume, and hence pressure, of fluid applied to the opposite ends of the spools 16, 18. The pilot valve block 32 contains a pair of control spools 34, the positions of which are controlled electromagnetically by controlling the current applied to a winding carried by each control spool 34, interaction between the resulting magnetic field and the magnetic field of an associated permanent magnet 36 being used to drive each control spool 34 for movement to desired positions. A control unit 40 is operable to control the current applied to each winding, and hence to control the position occupied by each control spool 34.

Each control spool 34 includes a series of lands which control communication between ports connected to return pressure, an intermediate pilot pressure, and the chambers at each end of each of the spools 16, 18.

Starting from the position illustrated, if the left hand control spool 34 were moved to the left, return pressure would be applied to the upper end of the left hand spool 16, pilot pressure being applied to the lower end thereof with the result that the spool 16 occupies its raised position. If this control spool 34 were moved to the right in the orientation illustrated, then the lower end of the spool 16 would be exposed to return pressure whilst the upper end is exposed to pilot pressure, resulting in downward movement of the spool 16. Control over the position occupied by the right hand spool 18 is achieved in a similar manner. It will be appreciated that the positions occupied by the control spools 34 can be controlled independently. Consequently, the positions occupied by the spools 16, 18 can also be controlled independently of one another.

Each control line 30 has a pressure transducer 38 associated therewith to permit the feedback to the associated control unit 40 of signals representative of the pressures being applied to the piston, in use. Further, a position transducer conveniently monitors the position of each of the spools 16, 18, the output of the position transducers being supplied to the control unit 40 to permit closed loop control over the spools 16, 18.

In use, an operator uses a control actuator, for example in the form of a joystick, to supply control signals to the control unit 40 indicative of, for example, the required direction and speed of movement of the arm, or of another parameter to be controlled. For example, if he wishes to raise the arm he may pull on the joystick, pushing of the joystick indicating that the arm is to be lowered. Thus, if it is sensed that the operator has pulled on the joystick to indicate that the arm is to be raised, the control unit 40 applies currents to the windings to urge the control spools 34 toward the positions illustrated, such movement resulting in the spools 16, 18 moving toward the positions shown, applying regulated pressures to the piston in an orientation such that the arm is raised. If, instead, the joystick is pushed to indicate that the arm is to be lowered, the positions occupied by the control spools 34 are switched, driving the spools 16, 18 in their alternative directions and resulting in the arm being lowered.

In the description hereinbefore the extreme positions of the spools 16, 18 have been described, i.e. the spool positions in which the supply or return port 20, 22 of each bore 12, 14 is fully open. However, it will be appreciated that the spools 16, 18 will normally be driven to intermediate positions. Further, as the spools 16, 18 are independent of one another and the positions occupied thereby are controllable independently of one another, a range of operating schemes are possible. For example, if the operator moves the joystick by a relatively large angle, the corresponding extreme position of the spools 16, 18 may be achieved to result in a relatively high speed movement of the arm. If the joystick angle is smaller, then the control unit 40 may reduce the degree of opening of, for example, the corresponding return port 22 so as to result in movement of the arm being at a reduced speed.

In accordance with the invention, the manner in which the control unit 40 controls the positions of the spools 16, 18 is dependent upon another operating characteristic or parameter of the control system. In this arrangement, the position of the arm, for example, is monitored and used by the control unit 40 in controlling the operation and movement of the spools 16, 18. If the position of arm is such that the end of the arm is relatively close to the operator's position, then the control unit controls movement of the arm using a first control scheme as set out above. If the position of the arm is such that the remote end thereof is further than a predetermined distance away from the operator's position, then a second control scheme is used. The second control scheme is designed to provide a greater degree of control over the movement of the arm, and this may be achieved by ensuring that, even for a relatively large angular displacement of the joystick, only a relatively small degree of opening of the associated valve port 22 or 20 is achieved with the result that the arm moves relatively slowly.

Thus it will be appreciated, that, in use, starting from a position in which the remote end of the arm is reasonably close to the operator, the operator can use the joystick to achieve relatively rapid movement of the arm towards a desired remote position. However, as that position is reached, the control arrangement will automatically switch to a control mode in which the operator has a greater degree of control, thereby allowing the operator to control the arm position precisely.

The arm position could be sensed directly using a suitable position sensor. However, it may be preferred to sense arm position by sensing the pressure within the associated piston cylinder.

In addition to achieving an improved degree of control accuracy, the provision of such an arrangement has the advantage that the control scheme used is dependent upon or related to, for example, the magnitude of the load being lifted or moved, possibly in conjunction with the position of the arm. A second control scheme for use in such conditions has a number of other advantages. For example, where the arm is being used to lift relatively high loads from remote locations, as the load is lifted, it accelerates and the output of associated pump needs to be increased to maintain a sufficient pressure to accommodate this. When the required speed has been attained, the pump output can be lowered. However, the time lags between commanding the movement of the load and the pump output changing results in the system pressure tending to oscillate i.e. in the aforementioned "hunting". The operator has to accommodate the system pressure oscillations when trying to control the movement of the arm. In the arrangement of the invention, as the initial part of the lifting movement may occur when the control unit 40 is operating under the second control scheme, the changes in arm position and speed of movement are more gradual than under the first control scheme with the result that fewer, smaller oscillations will be generated. As a result, control is significantly enhanced. Similarly, problems can be faced where the arm is being used to move relatively light loads, and the invention again serves to reduce such oscillations and hence permits improved control.

It will be appreciated that a range of other parameters could be sensed.

In an alternative embodiment, rather than using the sensed parameter in controlling the raising and lowering of an arm, the magnitude of the sensed parameter may be used to determine whether or not a stability control function is used. In the description hereinbefore where the raising and lowering of an arm is described, it will be appreciated that the motion of the arm is either being aided by or being countered by the effect of gravity. Where, rather than being used to control such movement of such an arm, the control arrangement is being used to control slewing motion, it will be appreciated that no gravitational assistance is present. In such an application, when slewing motion is required to commence, in order to overcome the initial inertia the system pressure needs to rise, requiring an increase in the associated pump output. Once slewing movement has commenced, the inertial effects having been overcome, the system pressure falls. As with the arrangement described hereinbefore, the time lag between the inertial effects being overcome and the pump output falling results in the system pressure oscillating around the desired value, and the operator has to compensate for the oscillating system pressure when controlling the operation of the device.

It is known to provide a controller to control acceleration at the commencement of such slewing movement, the controller serving to hold the pump output pressure at a substantially fixed, artificially high value. Although such systems provide improved control, and reduce hunting problems, and hence are advantageous, they are not energy efficient as the pump output is held at the artificially high level.

In this embodiment of the invention, when slewing motion is to commence, the control unit controls the positions of the spools 16, 18 in accordance with a first control scheme in which the stability control function is switched on. The first control scheme continues to be used until the load has been accelerated from zero to a predetermined proportion of the maximum speed of movement. Once this slewing speed has been reached, the control unit 40 controls the spool positions in accordance with a second control scheme in which the stability control function is switched off, and supply pressure is reduced thereby. As a result it will be appreciated that the benefits of a stability control function in reducing oscillations upon the commencement of slew movement can be achieved, thereby enhancing control, whilst permitting the energy losses associated with the use of such a control function to be reduced by automatically switching off the function, allowing the pressure to drop from the artificially high value, when the benefits associated therewith are no longer applicable.

The invention may also be used to assist in maintaining control when a load moves from a position in which movement thereof is assisted by gravity to a position in which movement is against the action of gravity, or vice versa. It will be appreciated that as the position at which gravitational assistance changes is passed, it would be easy for control to be lost. By switching between control schemes at that point, or as that point is being approached, the load can be moved past that point in a continuous, smooth fashion. It will be appreciated that such a control scheme may be of assistance in controlling the movement of, for example, an arm that is pivoted towards its upper end and which can be swung to both sides of the pivot point.

It will be appreciated that in all of the arrangements described hereinbefore control accuracy is enhanced. The control enhancements are achieved by switching between control schemes which relate operator demanded input signals to the positions occupied by the spools 16, 18, and thus can be incorporated in a simple and convenient manner, not requiring significant changes to be made to the control valves themselves. If desired, more than two control schemes may be provided, thereby permitting even greater improvements in control. Further, it may be possible for the control schemes to be user defined or modifiable to allow the user to determine how a particular joystick movement is interpreted and/or to permit control over the point or points at which switching between the control schemes occurs.

As mentioned hereinbefore, the control valve may have other forms of movable or slidable element than the spools mentioned herein, and the invention is equally applicable to such valves. Further, it may be used with valves having fewer or more movable elements, for example it may be used with arrangements having four individually movable valve elements.

A number of other modifications and alterations may be made to the arrangements described hereinbefore without departing from the scope of the invention.

The invention claimed is:

1. A control arrangement for use in a hydraulic control system, the control arrangement comprising:

a control valve having:

a main valve block including a first bore and a second bore;

a pilot valve block attached to the main valve block;

at least two movable elements;

wherein the control valve adapted to control a main flow through the valve; and a control unit, wherein the control arrangement is adapted to:

control the operation of the control valve in accordance with a first control scheme;

monitor an operating parameter of the control system;

control the operation of the control valve in accordance with a second control scheme in the event that the value of the operating parameter falls outside of a predetermined range; and control the operation of the movement of the at least two movable elements;

wherein the monitored operating parameter is related to speed of slew motion, the control arrangement being operable to switch between the first control scheme and the second control scheme when the speed of slew motion exceeds a predetermined speed;

wherein the first control scheme incorporates a stability function to assist control when the speed of slew motion, is less than the predetermined speed, and the second control scheme does not include the stability function;

wherein the at least two movable elements includes a first movable element, disposed in the first bore and a second movable element disposed in the second bore; and, the first movable element and the second movable element are each configured to move independently between respective first extreme positions, closed positions, and second extreme positions;

wherein the pilot valve block includes a first control spool and a second control spool, and the first control spool and the second control spool are both configured to move independently between respective first extreme positions, closed positions, and second extreme positions;

wherein the stability function of the first control scheme is arranged to achieve a relatively large change in position of at least one of the movable elements of the control valve for a given movement of a control actuator, the second scheme achieving a smaller change in position of the at least one of the moveable elements of the control valve for the same movement of the control actuator.

2. The control arrangement of claim 1, wherein the at least two movable elements comprise spools or poppets.

3. The control arrangement of claim 1, wherein the operating parameter which is monitored is representative of the position of a controlled member, the control arrangement being operable to switch between the first control scheme and the second control scheme when the position of the member exceeds a predetermined position.

4. The control arrangement of claim 1, wherein the first control spool is driven by a first magnet and the second control spool is driven by a second magnet.

5. The control arrangement of claim 1, wherein the operating parameter is the speed of movement of a controlled member.

6. The control arrangement of claim 1, wherein in a supply pressure of the second control scheme is lower than a supply pressure of the first control scheme.

7. The control arrangement of claim 6, wherein the supply pressure of the first control scheme corresponds to an artificially high pressure level produced by a pump, the artificially high pressure level configured to overcome inertial effects.

8. The control arrangement of claim 1, wherein the stability function reduces oscillations.

9. The control arrangement of claim 1, wherein the first and second control schemes are user defined.

10. The control arrangement of claim 1, wherein the first extreme position of the first movable element permits fluid flow between a first return port and a first control port, and the second extreme position of the first movable element permits fluid flow between a first supply port and the first control port.

11. The control arrangement of claim 1, wherein the closed positions are middle positions between the first extreme positions and the second extreme positions; the closed positions prevent fluid flow; the first extreme positions permit fluid flow in a first direction; and the second extreme positions permit fluid flow in a second direction.

12. The control arrangement of claim 1, the first control spool and the second control spool are disposed perpendicularly to the first movable element and the second movable element.

13. The control arrangement of claim 12, comprising a joystick attached to the pilot valve block.

14. The control arrangement of claim 12, wherein the first bore and the second bore are disposed parallel to each other and perpendicular to the first control spool and the second control spool.

15. A hydraulic control system comprising:

a. control valve having at least two movable elements disposed in respective bores of a main valve block, the control valve adapted to control a main flow through the valve, and a pilot valve block attached to the main valve block;

a control unit, the control unit adapted to (i) control the position of the moveable elements, (ii) monitor an operating parameter of the control system, the operating parameter related to speed of slew motion, and (iii) control the operation of the control valve in accordance with a first control scheme when the parameter has a value falling within a predetermined range, and to control the operation of the control valve in accordance with a second control scheme in the event that the value of the operating, parameter falls outside of the predetermined range, wherein the first control scheme includes a stability function that reduces oscillation by limiting movement of the movable elements for a given movement of a control actuator, and the second control scheme does not include the stability function;

wherein the at least two movable elements are each configured to move independently between respective first extreme positions, closed positions, and second extreme positions;

wherein the pilot valve block includes a first control spool and a second control spool, and the first control spool and the second control spool are both configured to move independently between respective first extreme positions, closed positions, and second extreme positions; and wherein the stability function of the first control scheme is arranged to achieve a relatively large change in position of at least one of the movable elements of the control valve for a given movement of a control actuator, the second control scheme achieving a smaller change in position of the at least one of the moveable elements of the control valve for the same movement of the control actuator.

16. The control arrangement of claim 15, wherein the at least two movable elements comprise spools or poppets.

17. A control arrangement for use in a hydraulic control system, the control arrangement comprising:

a control valve having:

a main valve block including a first bore and a second bore;

at least two movable elements;

wherein the control valve adapted to control a main flow through the valve; and a control unit, wherein the control arrangement is adapted to:

control the operation of the control valve in accordance with a first control scheme;

monitor an operating parameter of the control system;

control the operation of the control valve in accordance with a second control scheme in the event that the value of the operating parameter falls outside of a predetermined range; and control the operation of the movement of the at least two movable elements;

wherein the monitored operating parameter is related to speed of slew motion, the control arrangement being operable to switch between the first control scheme and the second control scheme when the speed of slew motion exceeds a predetermined speed;

wherein the first control scheme incorporates a stability function to assist control when the speed of slew motion is less than the predetermined speed, and the second control scheme does not include the stability function;

wherein the at least two movable elements includes a first movable element disposed in the first bore and a second movable element disposed in the second bore; and, the first movable element and the second movable element are each configured to move independently between respective first extreme positions, closed positions, and second extreme positions; and wherein the stability function of the first control scheme is arranged to achieve a relatively large change in position of at least one of the movable elements of the control valve for a given movement of a control actuator, the second scheme achieving, a smaller change in position of the at least one of the moveable elements of the control valve for the same movement of the control actuator.

18. The control arrangement of claim 17, comprising a pilot valve block attached to the main valve block; wherein the pilot valve block includes a first control spool and a second control spool.

19. The control arrangement of claim 18, wherein the first control spool and the second control spool are both configured to move independently between respective first extreme positions, closed positions, and second extreme positions.

20. The control arrangement of claim 17, wherein the control arrangement is adapted to control the operation of the control valve in accordance with the second control scheme if a load moves between a first position in which movement of the load is assisted by gravity to a second position in which movement of the load is against forces of gravity.

* * * * *